US007387372B2

(12) United States Patent
Ishikawa et al.

(10) Patent No.: US 7,387,372 B2
(45) Date of Patent: Jun. 17, 2008

(54) LIQUID DELIVERY APPARATUS

(75) Inventors: Hiroyuki Ishikawa, Nisshin (JP); Hiroto Sugahara, Ama-gun (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 216 days.

(21) Appl. No.: 10/946,117

(22) Filed: Sep. 22, 2004

(65) Prior Publication Data

US 2005/0068377 A1 Mar. 31, 2005

(30) Foreign Application Priority Data

Sep. 25, 2003 (JP) ..... 2003-333967
Aug. 17, 2004 (JP) ..... 2004-237625

(51) Int. Cl.
*B41J 2/045* (2006.01)

(52) U.S. Cl. ..... 347/68; 347/70; 347/71

(58) Field of Classification Search ..... 347/68, 347/70–72

See application file for complete search history.

(56) References Cited

U.S. PATENT DOCUMENTS 5,530,465 A * 6/1996 Hasegawa et al. ..... 347/70
5,831,171 A * 11/1998 Huang ..... 73/753
5,956,829 A * 9/1999 Kitahara et al. ..... 29/25.35
7,121,651 B2 * 10/2006 Takahashi et al. ..... 347/71
2003/0107622 A1 * 6/2003 Sugahara ..... 347/71
2003/0210306 A1 * 11/2003 Takahashi et al. ..... 347/71

FOREIGN PATENT DOCUMENTS

JP A 63-057250 3/1988
JP A 11-300971 11/1999
JP A 2003-025568 1/2003

* cited by examiner

*Primary Examiner*—Matthew Luu
*Assistant Examiner*—Lisa M Solomon
(74) *Attorney, Agent, or Firm*—Oliff & Berridge, PLC

(57) ABSTRACT

There is disclosed a liquid delivery apparatus comprising a pressure chamber accommodating a liquid and communicated with an opening, and a piezoelectric actuator plate which is disposed to close the pressure chamber and is deflected to deliver the liquid accommodated in the pressure chamber through the opening. The actuator plate has a laminated structure including: a piezoelectric layer which is deformable at least in a planar direction thereof by an application of an electric field to the piezoelectric layer; and a planar diaphragm laminated at one of opposite surfaces thereof to the piezoelectric layer, the one surface comprising a fixed portion which is fixed to the piezoelectric layer, and a non-fixed portion which is not fixed to the piezoelectric layer and is provided over a central part of the pressure chamber.

21 Claims, 13 Drawing Sheets

LIQUID DELIVERY APPARATUS

The present application is based on Japanese Patent Application Nos. 2003-333967 and 2004-287625 filed on Sep. 25, 2003 and Aug. 17, 2004, respectively, the contents of which are incorporated herein by reference.

BACKGROUND OF THE INVENTION

1. Field of the Invention

The present invention relates to a liquid delivery apparatus, and particularly to a liquid delivery apparatus driven by a piezoelectric element.

2. Discussion of Related Art

As a kind of liquid delivery apparatus, there is conventionally known an ejecting apparatus where a plurality of pressure chambers each accommodating a liquid is closed by, for example, a diaphragm which is bonded to and locally deflected by a plurality of piezoelectric elements so as to eject a droplet of the liquid from corresponding nozzles. For instance, such an apparatus is disclosed in JP-A-11-300971, which teaches a head of unimorph type where a recess is formed at an area in a diaphragm so as to oppose to a corresponding one of upper electrodes, so as to increase an amount of displacement of the diaphragm.

The conventional liquid delivery apparatus is so constructed that an area of a piezoelectric element which corresponds to a position of the corresponding pressure chamber and is to be deflected has a laminated structure which is obtained by superposing the piezoelectric element on a diaphragm and bonding the piezoelectric element and diaphragm to each other. Thus, the piezoelectric element and the diaphragm are integrally deformed when the piezoelectric element is driven. According to this arrangement where the piezoelectric element and diaphragm deform integrally at the area corresponding to the pressure chamber, the deformation of the piezoelectric element is restricted by the presence of the diaphragm, leading to an insufficient deformation of the piezoelectric element and accordingly a limited displacement of the diaphragm.

SUMMARY OF THE INVENTION

The present invention has been developed in view of the above-described situations, and an object of the invention is, therefore, to provide a liquid delivery apparatus comprising a piezoelectric element which drives a diaphragm to deliver a liquid, wherein the deformation of the piezoelectric element is increased so that the amount of displacement of the diaphragm is effectively increased.

To attain the above object, the invention provides a liquid delivery apparatus comprising a pressure chamber accommodating a liquid and communicated with an opening, and a piezoelectric actuator plate which is disposed to close the pressure chamber and is deflected to deliver the liquid accommodated in the pressure chamber through the opening. The actuator plate has a laminated structure including: a piezoelectric layer which is deformable at least in a planar direction thereof by an application of an electric field to the piezoelectric layer; and a planar diaphragm laminated at one of opposite surfaces thereof to the piezoelectric layer, the one surface comprising a fixed portion which is fixed to the piezoelectric layer, and a non-fixed portion which is not fixed to the piezoelectric layer and is provided over a central part of the pressure chamber.

It is noted that fixing a planar surface of the diaphragm and the piezoelectric layer to each other includes both direct and indirect fixing. In the case of the indirect fixing, another member such as an electrode is interposed between the diaphragm and the piezoelectric layer.

According to the invention, the piezoelectric layer is allowed, at the non-fixed portion, to deform without being restricted by the presence of the diaphragm, thereby increasing the deformation of the piezoelectric layer.

BRIEF DESCRIPTION OF THE DRAWINGS

The above and other objects, features, advantages and technical and industrial significance of the present invention will be better understood by reading the following detailed description of preferred embodiments of the invention, when considered in connection with the accompanying drawings, in which:

FIG. 5A shows a state where a piezoelectric actuator plate is not driven, while FIG. 5B shows a state where the actuator plate is driven;

FIG. 10A shows a state where a piezoelectric actuator plate is not driven, while FIG. 10B shows a state where the actuator plate is driven;

FIG. 11A shows a state where a piezoelectric actuator plate is not driven, while FIG. 11B shows a state where the actuator plate is driven;

FIG. 12A shows a state where a piezoelectric actuator plate is not driven, while FIG. 12B shows a state where the actuator plate is driven.

DETAILED DESCRIPTION OF THE PREFERRED EMBODIMENTS

There will be described several embodiments of the invention by reference to the accompanying drawings.

First Embodiment

Figure 1:
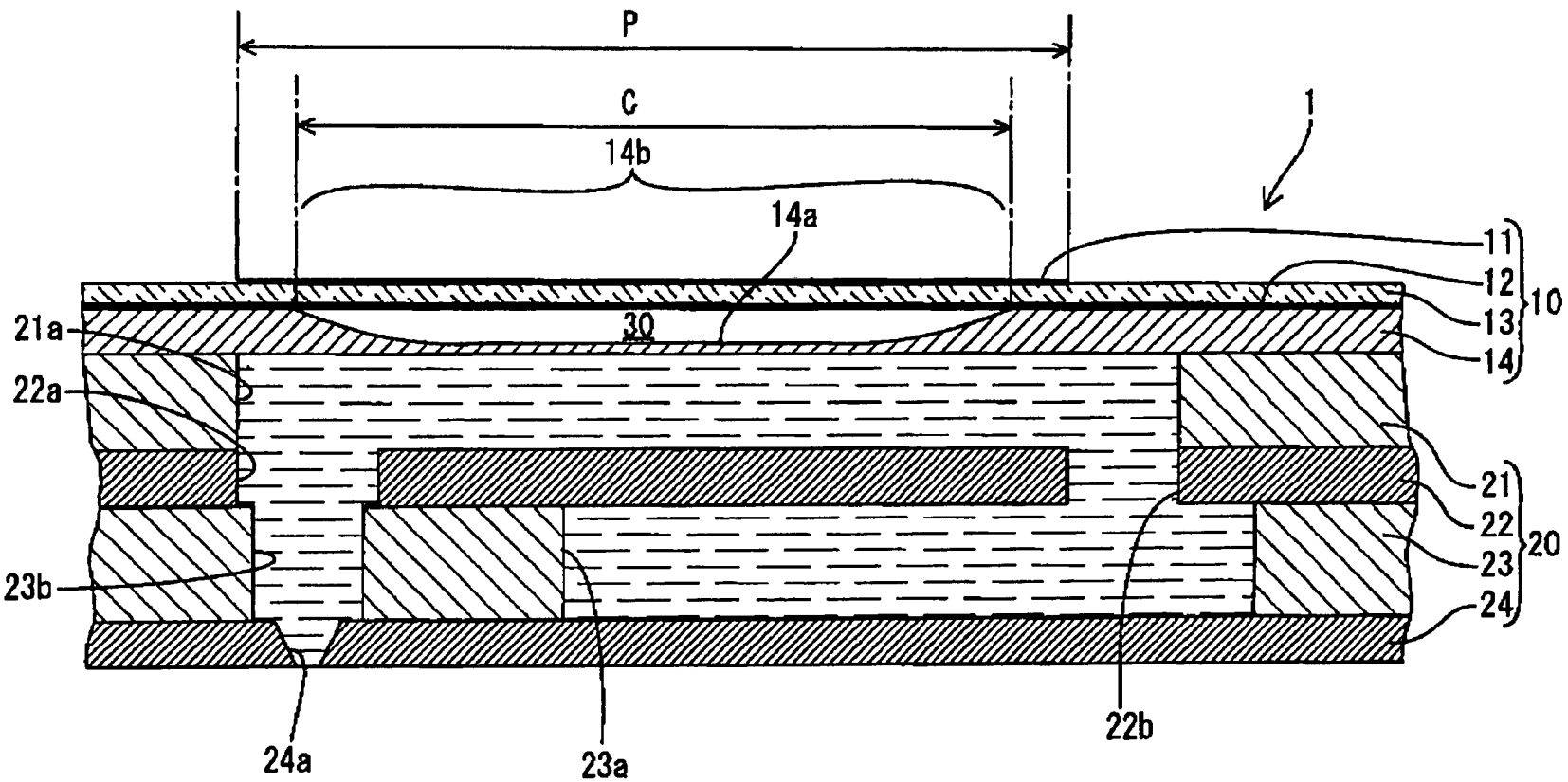
FIG. 1 is a cross sectional view of a liquid delivery apparatus according to a first embodiment of the present invention, as taken along a longitudinal direction of a pressure chamber.
Figure 2:
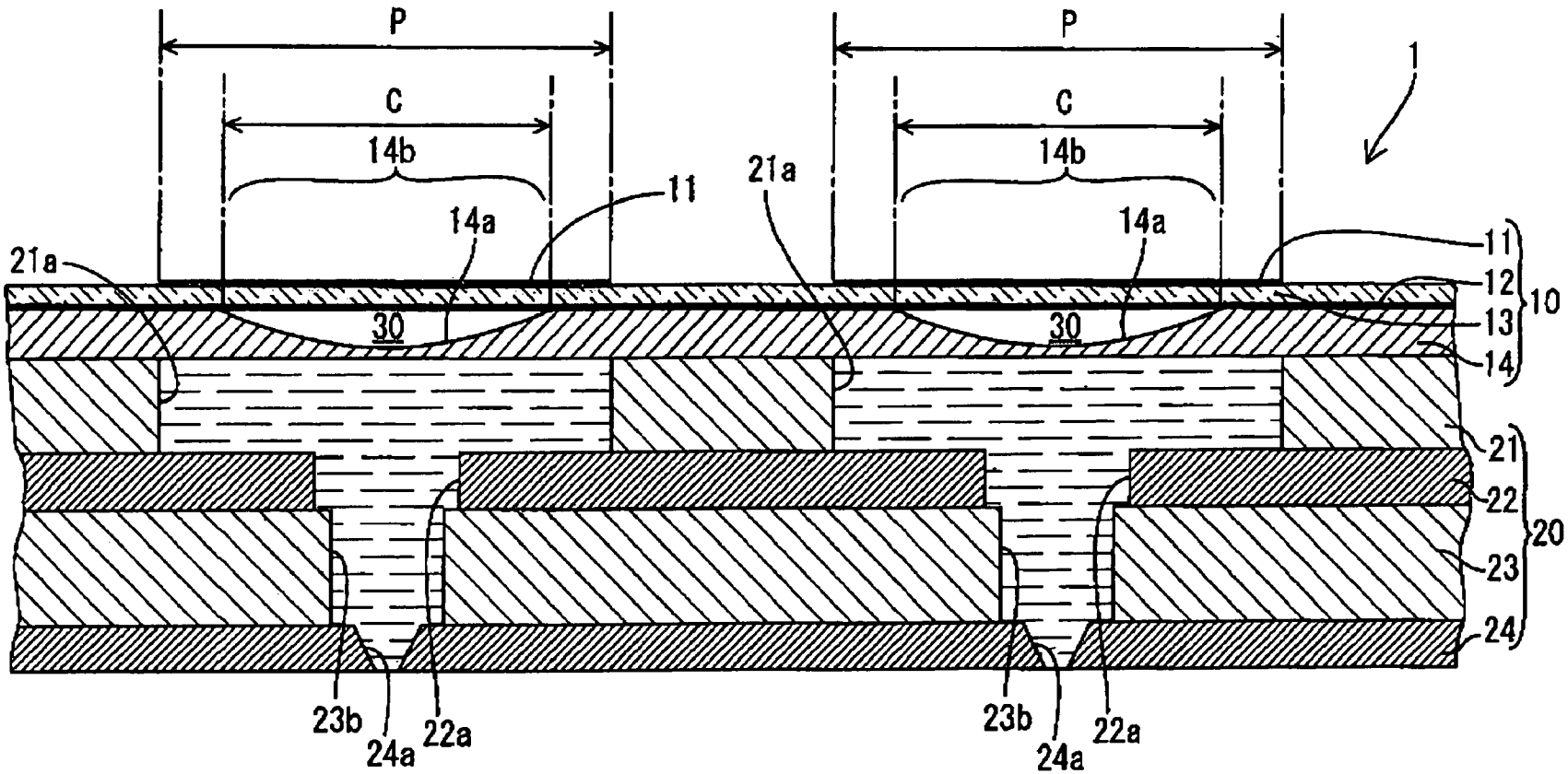
FIG. 2 is a cross sectional view as taken in a direction of an array of a plurality of pressure chambers of the liquid delivery apparatus.
Figure 3:
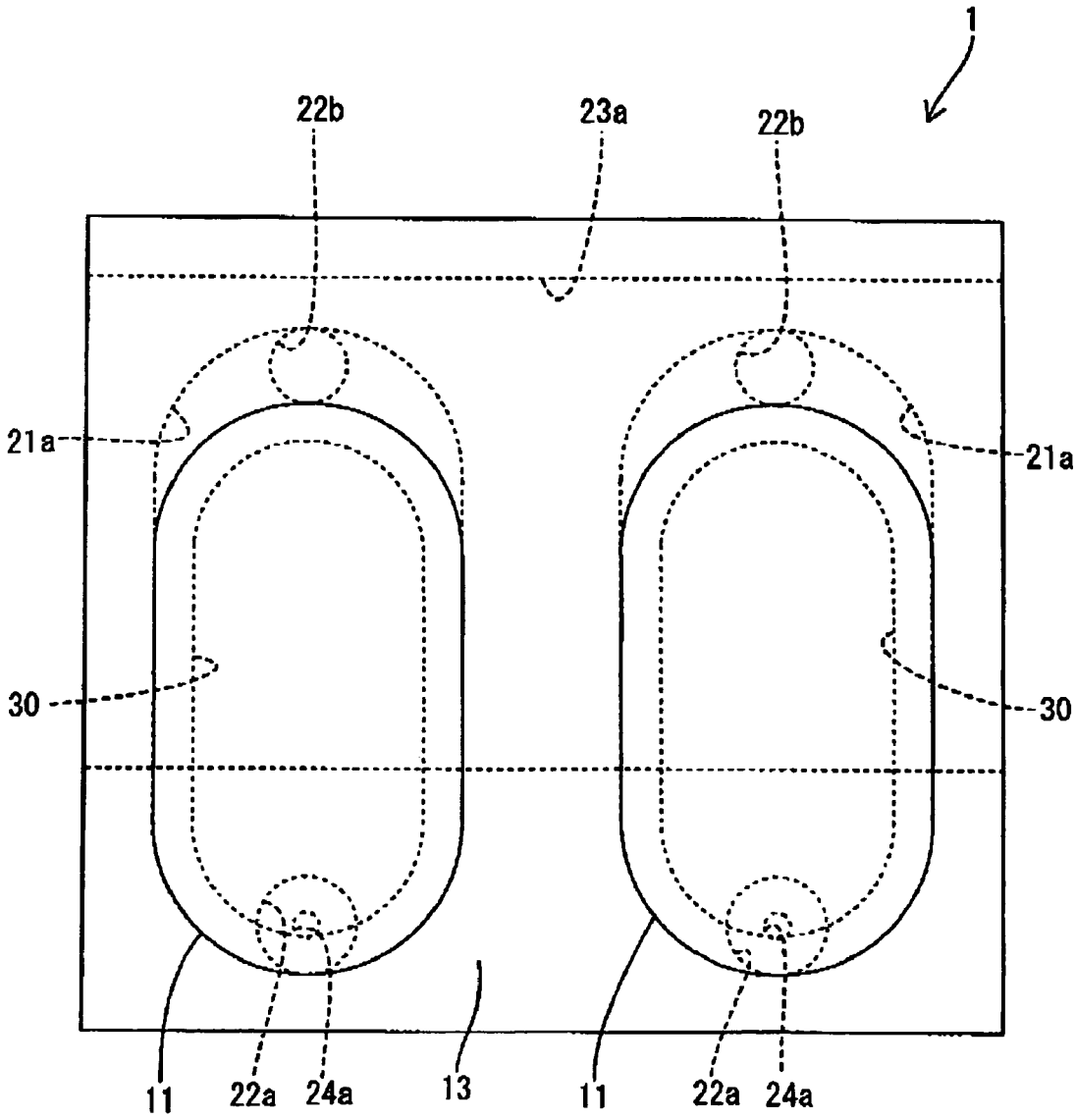
FIG. 3 is a plan view of the liquid delivery apparatus.
Figure 4A:
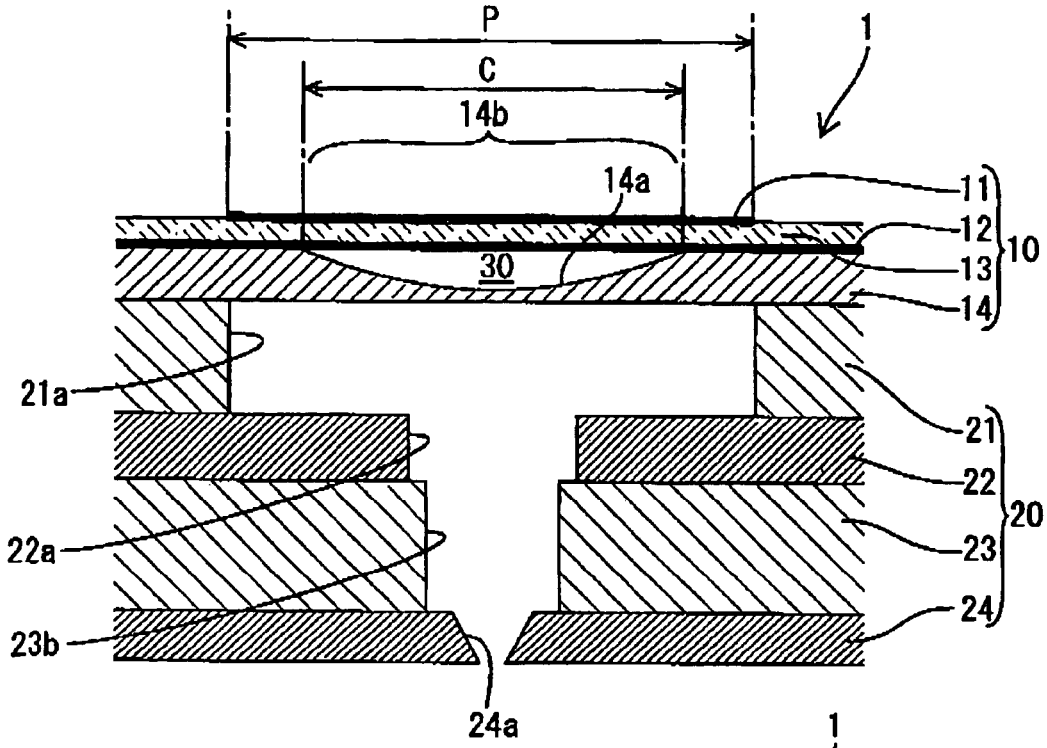
FIGS. 4A and 4B are cross sectional views respectively showing a non-operated and an operated state of a piezoelectric actuator plate of the liquid delivery apparatus.
Figure 4B:
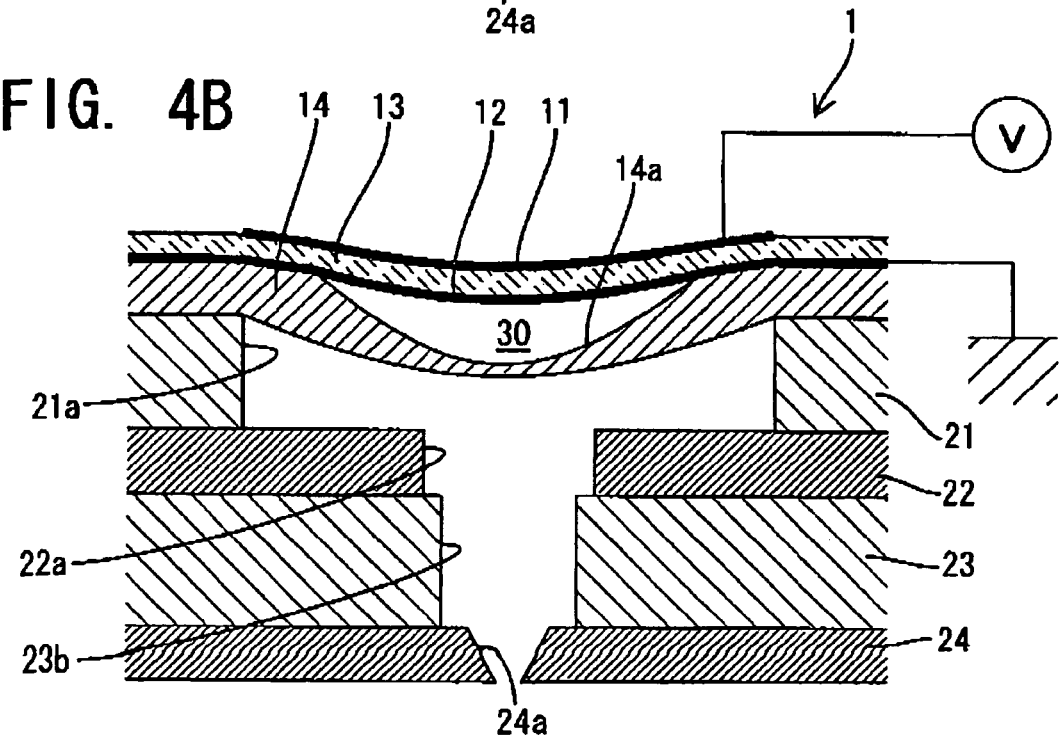

A liquid delivery apparatus 1 according to a first embodiment of the invention will be first described by reference to FIGS. 1-4. FIG. 1 shows a cross section of a pressure chamber 21*a* of the liquid delivery apparatus 1 taken along a line extending in the longitudinal direction of the chamber 21*a*, while FIG. 2 is a cross sectional view of the apparatus 1 taken along an array of a plurality of pressure chambers 21*a*. FIG. 3 is a plan view of the apparatus 1 shown in FIGS. 1 and 2. FIGS. 4A and 4B are fragmentary enlarged views of the apparatus 1 as shown in FIG. 2. FIG. 4A shows a non-operated state where a piezoelectric actuator plate 10 is not driven, while FIG. 4B shows an operated state where the piezoelectric actuator plate 10 is driven.

As shown in FIGS. 1 and 2, the liquid delivery apparatus 1 of the present embodiment takes, by way of example, the form of an ink jet head for ejecting droplets of an ink, as a kind of liquid ejecting apparatus capable of emitting a jet of a liquid. The liquid delivery apparatus 1 comprises a cavity plate 20 partially defining therein a plurality of pressure chambers 21*a* in each of which is accommodated the ink to be ejected, and a piezoelectric actuator plate 10 bonded to the cavity plate 20 to define the pressure chambers 21*a* in cooperation with the cavity plate 20.

The cavity plate 20 has a multilayer structure in which is defined ink passages, and which includes: a nozzle plate 24 having a plurality of ink ejecting nozzles 24*a* arranged in a row and each constituting an opening; a manifold plate 23 superposed on the nozzle plate 24; a passage plate 22 superposed on the manifold plate 23; and a chamber plate 21 superposed on the passage plate 22. The plates 21-24, each of which is a generally planar member, are mutually bonded with an epoxy adhesive having a thermosetting property.

Each of the chamber plate 21, passage plate 22 and manifold plate 23 is formed of a metallic material such as a stainless steel. The chamber plate 21 is configured to partially define a plurality of pressure chambers 21*a* arranged in a row. Each of the pressure chambers 21*a* accommodates the ink which is to be ejected in droplets in accordance with selective operation of the piezoelectric actuator plate 10, which will be described later. The passage plate 22 is configured to define pressure passages 22*a* and manifold passages 22*b*. A pressure passage 22*a* and a manifold passage 22*b* are in communication with one of the pressure chambers 21*a*, at opposite end portions of the pressure chamber 21*a* in the longitudinal direction of the chamber 21*a*. The manifold plate 23 is configured to partially define a manifold 23*a* in communication with a liquid tank (not shown), and nozzle passages 23*b* connected to the respective pressure passages 22*a*.

The nozzle plate 24 is made of a polyimide resin and is configured to define or include a plurality of nozzles 24*a* connected to the respective nozzle passages 23*b*, as shown in FIG. 1. In the liquid delivery apparatus 1 constructed as described above, the liquid or ink stored in the liquid tank is supplied to each of the nozzles 24*a* via the manifold 23*a* and the corresponding manifold passage 22*b*, pressure chamber 21*a*, pressure passage 22*a*, and nozzle passage 23*b*.

There will next be described the piezoelectric actuator plate 10.

As shown in FIGS. 1, 2 and 4, the piezoelectric actuator plate 10 has a laminated structure comprising a diaphragm 14 which is formed of a substantially planar member of a metallic material having an electric conductivity, such as a stainless steel and a piezoelectric layer 13 disposed on the diaphragm 14. The diaphragm 14 constitutes a deflection layer. Two electrode layers (i.e., an upper electrode 11 and a lower electrode 12) are disposed on the respective opposite surfaces of the piezoelectric layer 13 so that the electrode layers are opposed to each other via the piezoelectric layer 13. The diaphragm 14 is fixed to the piezoelectric layer 13 via the lower electrode 12.

The lower electrode 12 disposed on the diaphragm 14 is a thin film conductor printed on, or affixed to, the under surface of the piezoelectric layer 13. The lower electrode 12 is, as schematically shown in FIG. 4B, connected to a ground of a drive circuit. On the other hand, the upper electrode 11 opposed to and disposed over the lower electrode 12 via the piezoelectric layer 13 is, as schematically shown in FIG. 4B, electrically connected to a positive power supply of the drive circuit via a switching device. The upper electrode 11 is a thin film conductor printed on, or affixed to, the piezoelectric layer 13, similarly to the lower electrode 12.

A surface of the diaphragm 14 which is fixed to the piezoelectric layer 13 via the lower electrode 12 as described above includes a non-fixed portion 14*b* which is not fixed to the piezoelectric layer 13 and is located at an area C corresponding to a central part of the pressure chamber 21*a* as seen from the upper side of the liquid delivery apparatus, i.e., as seen from a direction perpendicular to a planar direction of the actuator plate 10. A thickness of the diaphragm 14 at least at a part of the non-fixed portion 14*b* is made thinner than at the fixed portion of the diaphragm 14, 80 that the part constitutes a thinner portion 14*a*. According to the present embodiment, an entirety of the non-fixed portion 14*b* is made thinner than the fixed portion. In other words, the non-fixed portion 14*b* and the thinner portion 14*a* positionally correspond to each other. However, the thinner portion 14*a* may be formed as a part of the non-fixed portion 14*b*.

The thinner portion 14*a* is configured such that the thickness thereof is gradually reduced in the planar direction (i.e., respective lateral directions as seen in FIGS. 1 and 2) from its peripheral part toward its central part which positionally corresponds to the central part of the pressure chamber 21*a*. According to this arrangement, efficiency of displacement of the thinner portion is enhanced. The thinner portion 14*a* is provided by forming the diaphragm 14 such that one side of the diaphragm 14 opposite to the pressure chamber 21*a* has a recess at the area C corresponding to the central part of the pressure chamber 21*a*, making a height or level of the upper surface of the diaphragm 14 at the area C lower than that at the other part fixed to the lower electrode 12 (i.e., the other area of the upper surface of the diaphragm 14 than the area corresponding to the non-fixed portion 14*b*). By the presence of this recess defined by the thinner portion 14*a*, there is formed a void 30 between the upper surface of the thinner portion 14*a* (or the upper side of the non-fixed portion 14*b*) and the under side of the lower electrode 12. The recess is preferably formed by etching a planar member as a material of the diaphragm 14, in view of benefits obtained by employing such a way of forming, i.e., improvement in the manufacturing efficiency and reduction in the cost. However, the way of forming the recess is not limited to the etching, but the recess may be otherwise formed, for instance, by machining.

As shown in FIG. 3, the pressure chamber 21*a* as seen from the upper side has an oblong shape, and a circumference of the non-fixed portion 14*b* (i.e., a circumference of the void 30) is located right over, or over the immediately inner side of, a circumference of the pressure chamber 21*a*. That is, as seen from the upper side of the apparatus 1, the circumference of the non-fixed portion 14*b* (or the circumference of the void 30) is not located outside the pressure chamber 21*a*. In other words, the entirety of the non-fixed portion 14*b* is disposed within the pressure chamber 21*a*. More specifically, as seen from the upper side, the thinner portion 14*a* has an oblong shape which is similar to, but slightly smaller than, a shape of the pressure chamber 21*a*. According to this arrangement, the non-fixed portion 14*b* has a relatively low rigidity, thereby enhancing the efficiency of the deformation of the piezoelectric actuator plate.

As shown in FIGS. 1, 2, and 4, an opposing area P where two electrode layers (i.e., an upper electrode 11 and a lower electrode 12) are opposed to each other via the piezoelectric layer 13 is wider than the area of the non-fixed portion 14*b* such that the opposing area P extends over the entirety of the non-fixed portion 14*b* or of the void 30. In the plan view of FIG. 3 is shown an arrangement where the area of the upper electrode 11 corresponds to the opposing area P of the electrode layers, and the area of the non-fixed portion 14*b* or the void 30 is made slightly smaller than the opposing area P. According to this arrangement, the piezoelectric layer can effectively deform at a part positionally corresponding to the non-fixed portion.

The piezoelectric layer 13 as fixed to the upper surface of the diaphragm 14 is formed of a piezoelectric ceramic material, more specifically, lead (Pb)-zirconate-titanate (PZT). However, the piezoelectric layer 13 may be formed of any other piezoelectric materials such as barium titanate, lead titanate, and Roschelle salt. The piezoelectric layer 13 is formed on the diaphragm 14 to together construct a laminated structure having a uniform thickness. A step of bonding the piezoelectric layer 13 and the diaphragm 14 to each other may be performed such that the upper electrode 11 and the lower electrode 12 are disposed on the respective surfaces of the piezoelectric layer 13 which is prepared in advance, and then the assembly of the piezoeletric layer 13 and the two electrodes 11, 12 is bonded with an adhesive having an electric conductivity to the diaphragm 14 having the thinner portion 14*a* which has been formed beforehand.

There will be described an operation of the liquid delivery apparatus 1 by reference to FIGS. 4A and 4B.

When the liquid delivery apparatus 1 of the present embodiment is in its non-operated state, a voltage is not applied between the two electrodes 11, 12, and therefore a deflection of the piezoelectric actuator plate 10 is not induced, as shown in FIG. 4A. When it is necessary to eject the ink droplet from a nozzle 24*a* of the apparatus 1, an operating state of the switching device is switched so as to apply a power supply voltage to the upper electrode 11. Accordingly, a voltage is generated between the upper and lower electrodes 11, 12, applying an electric field to the piezoelectric layer 13. Thus, the piezoelectric layer 13 expands in a direction of its thickness (i.e., vertical direction as seen in FIG. 4A), namely, toward the pressure chamber 21*a*, at the area C positionally corresponding to the pressure chamber 21*a*, while contracting in the planar direction (i.e., the lateral direction as seen in FIG. 4A).

Since the thinner portion 14*a* of the diaphragm 14 has a lower degree of rigidity than the other portion of the diaphragm 14, and is not fixed to the piezoelectric layer 13 also, the thinner portion 14*a* is easily deflected or bent toward the pressure chamber 21*a* immediately after an initiation of contraction of the piezoelectric layer 13 in the planar direction. The piezoelectric layer 13 is pulled to the pressure chamber 21*a* with the bending of the thinner portion 14*a*. As a result, the piezoelectric actuator plate 10 is deflected to be convex toward the pressure chamber 21*a* (i.e., toward the lower side in FIG. 41B). As shown in FIG. 4B, the deflection of the piezoelectric actuator plate 10 toward the pressure chamber 21*a* reduces the inner volume of the pressure chamber 21*a*, increasing the inner pressure of the pressure chamber 21*a*. Thus, the ink droplet is ejected from the nozzle 24*a* via the corresponding pressure passage 22*a* and nozzle passage 23*b*.

After a droplet of the ink is ejected from the nozzle 24*a* by being pressurized at the pressure chamber 21*a*, the switching device is switched, and the application of the power supply voltage to the upper electrode 11 from the drive circuit is cut off. The contraction of the piezoelectric layer 13 in the planar direction is accordingly eliminated and the piezoelectric layer 12 restores to its original position. Thus, the pressure chamber 21*a* is replenished with the ink sucked from the liquid tank or ink tank (not shown) and delivered through the common manifold 23*a* and the corresponding manifold passage 22*b* (see FIG. 1).

Second Embodiment

By reference to FIGS. 5A and 5B, there will be described a second embodiment of the invention.

A liquid delivery apparatus according to the second embodiment is arranged such that a diaphragm corresponding to a deflection layer is constituted by a laminated structure comprising a plurality of planar members, and a through-hole is formed through the thickness of at least one of the plurality of planar members so as to form a thinner portion of the diaphragm. The apparatus according to the second embodiment is different from that according to the first embodiment only in the structure of the non-fixed portion of the diaphragm, and therefore the similar elements are denoted by the same reference numerals and detailed description thereof is dispensed with.

Figure 5A:
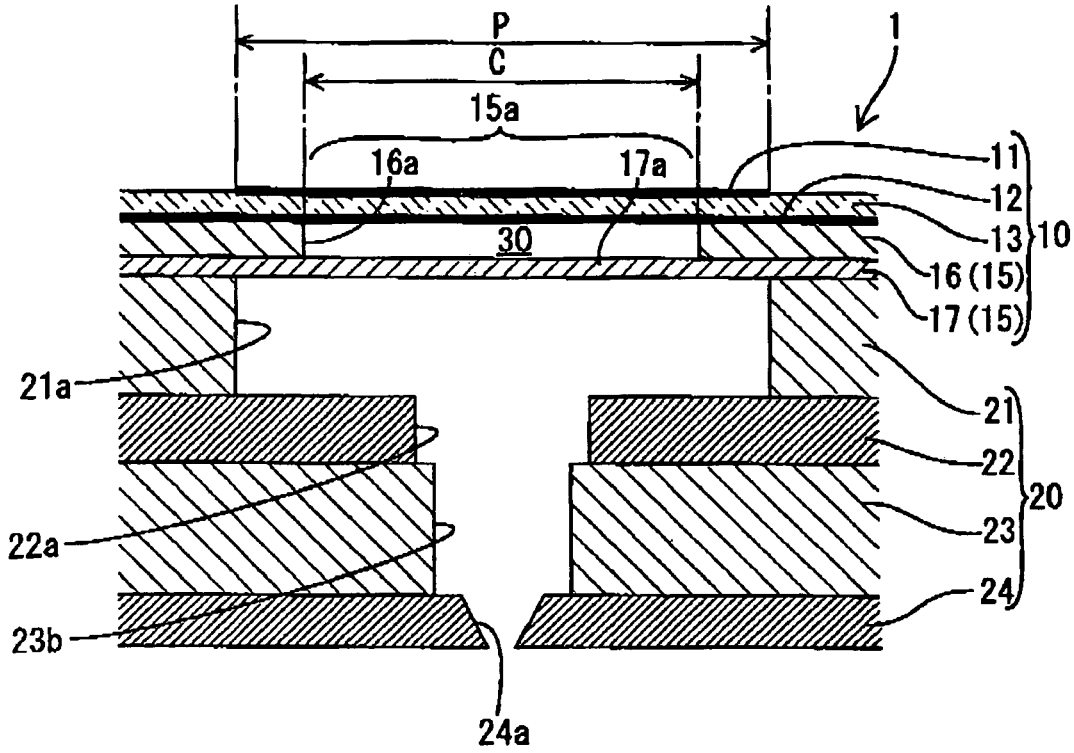
FIGS. 5A and 5B are cross sectional views as taken along the shorter side of a pressure chamber of a liquid delivery apparatus of a second embodiment of the invention.
Figure 5B:
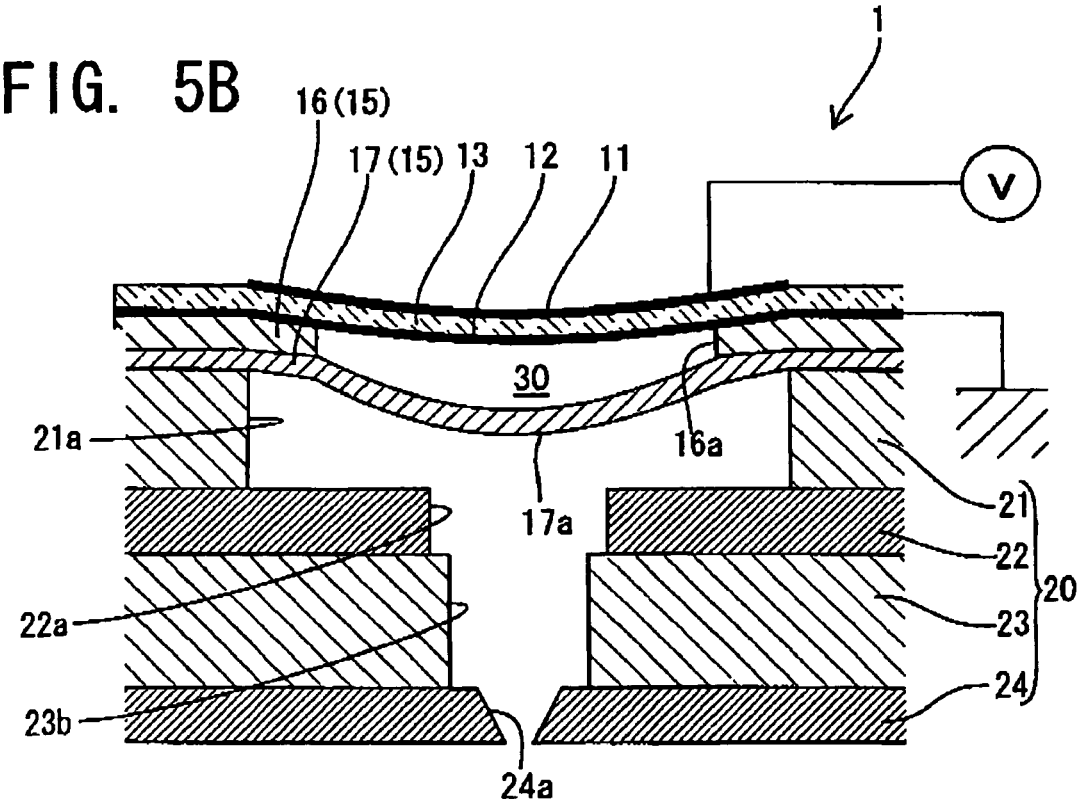

FIG. 5A is a view of the liquid delivery apparatus 1 of the second embodiment, which is modified from the apparatus according to the first embodiment shown in FIG. 4A. In FIG. 5A, the diaphragm 15 is constituted by a laminated structure comprising two planar members, namely, a first planar member 16 and a second planar member 17. A through-hole 16*a* is formed through the first planar member 16, thereby forming a thinner portion 17*a* at a part of the second planar member 17 positionally corresponding to the through-hole 16*a*. The diaphragm 15 is configured such that a part thereof corresponding to the through-hole 16*a* has a recess defined by the thinner portion 17*a* as a bottom. The thinner portion 17*a* corresponds to a non-fixed portion 15*a* of the diaphragm 15 and is not fixed to a lower electrode 12. On the other hand, the first planar member 16 of the diaphragm 15 is fixed to the piezoelectric layer 13 at the part other than the part where the through-hole 16*a* is formed, via the lower electrode 12. When driven, the thus arranged piezoelectric actuator plate 10 operates as shown in FIG. 5B, similarly to the apparatus of the first embodiment, that is, deflects to be convex toward the pressure chamber 21*a*.

According to the second embodiment, the thinner portion of the diaphragm can be easily formed.

Third Embodiment

Figure 6:
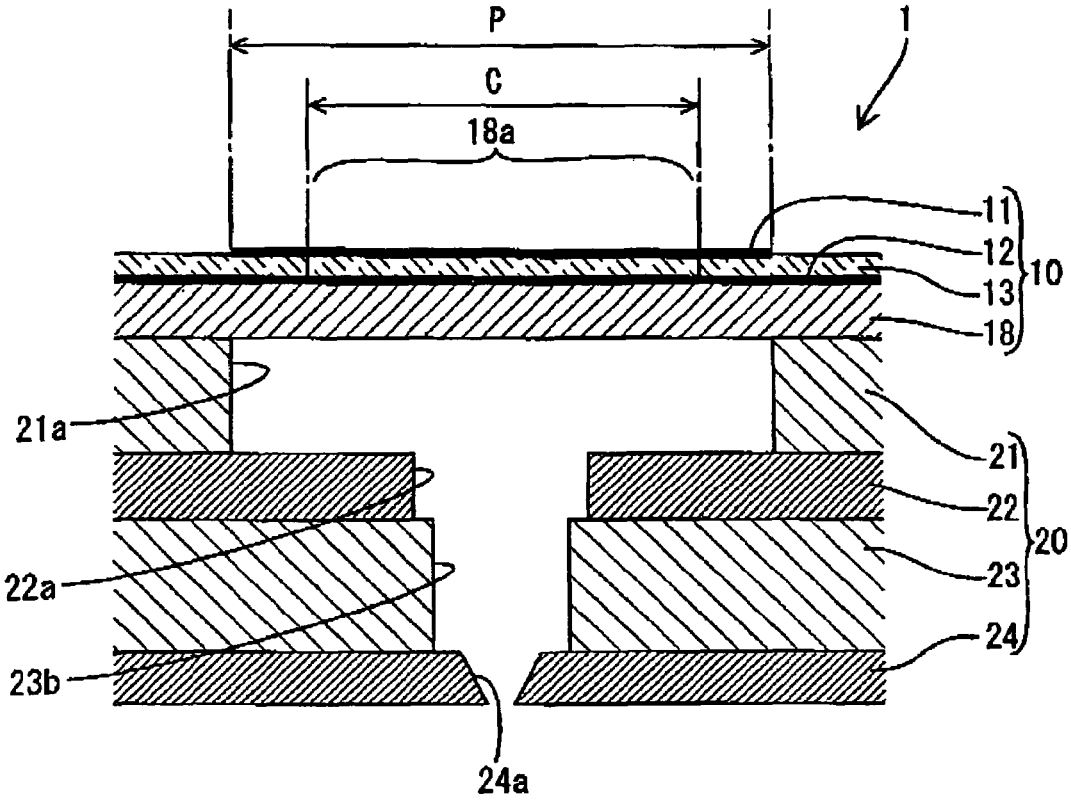
FIG. 6 is a view showing a part of a liquid delivery apparatus according to a third embodiment of the invention.

Although in the first and second embodiments, a void is present between the non-fixed portion of the diaphragm and the lower electrode, a liquid delivery apparatus according to a third embodiment of the invention is arranged such that such a void is not provided, or, merely a slight void is provided. FIG. 6 is a view of the liquid delivery apparatus according to the third embodiment, which is modified from the apparatus according to the first embodiment shown in FIG. 4A. The liquid delivery apparatus 1 of the third embodiment is different from the above-described second embodiment in that a diaphragm 18 in the form of a single planar member is provided, instead of the diaphragm 15 constituted by a laminated structure of a plurality of planar members. At an area C corresponding to a central part of the pressure chamber 21*a*, the diaphragm 18 is not fixed to the lower electrode 12. The part of the diaphragm 18 not fixed to the lower electrode 12 constitutes a non-fixed portion 18*a* of the diaphragm 18.

At the outer side of the area C, the diaphragm 18 is fixed to the lower electrode 12. Thus, a part, corresponding to the area C, of an upper surface of the diaphragm 18 which is plane and is held in contact with, or very close to, the lower electrode 12, is not bonded to the lower electrode 12 while the other part of the upper surface is fixed or bonded to the lower electrode with an adhesive or other suitable means. When driven, a piezoelectric actuator plate 10 of the thus configured liquid delivery apparatus 1 deflects to be convex toward the pressure chamber 21*a*, similarly to the above-described first and second embodiments.

Fourth Embodiment

Although the liquid delivery apparatus in the form of a liquid ejecting apparatus has been described in each of the embodiments above by way of example, a liquid delivery apparatus according to a fourth embodiment of the invention has a delivery function other than that by ejection.

Figure 7:
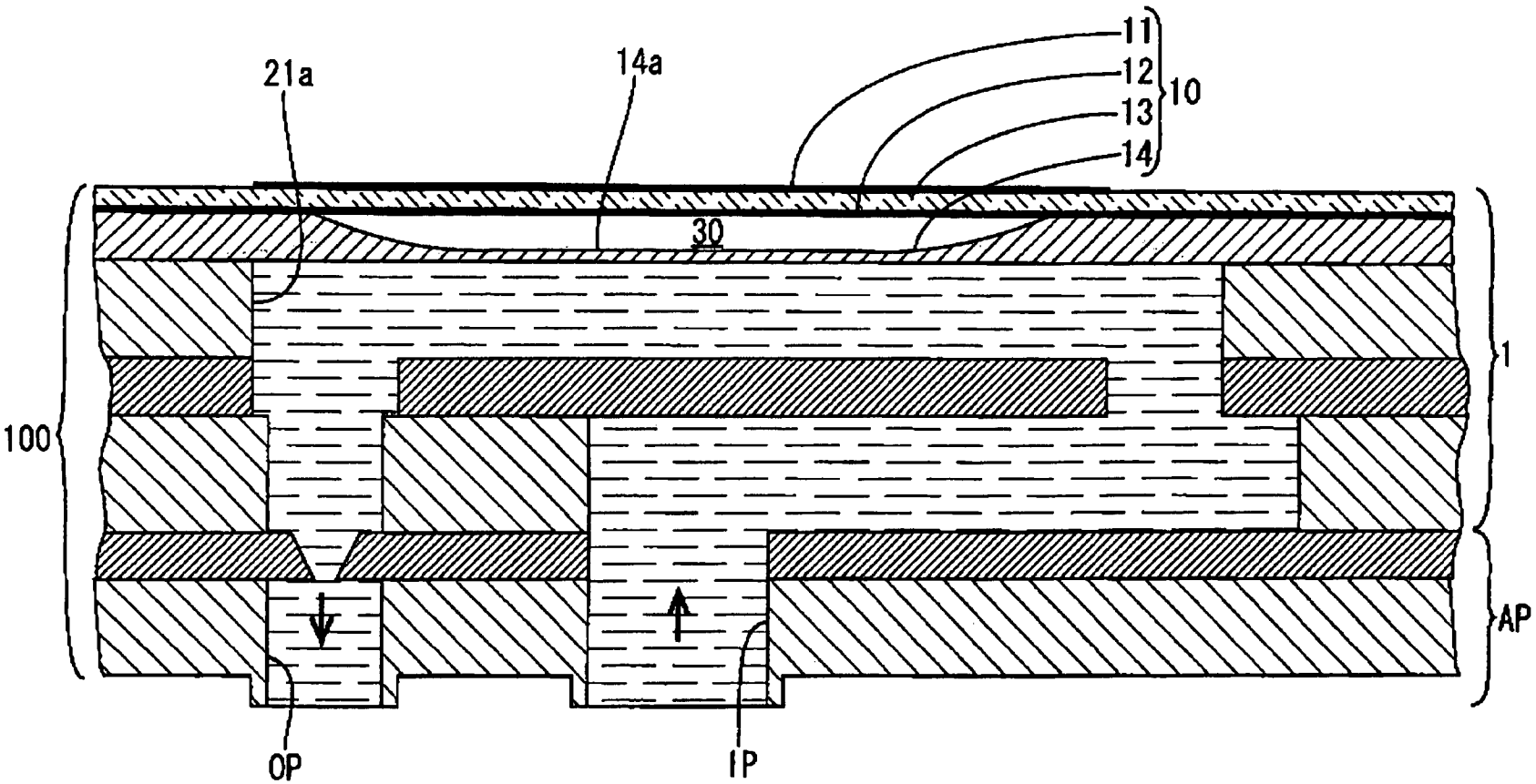
FIG. 7 is a view showing a part of a liquid delivery apparatus according to a fourth embodiment of the invention.

FIG. 7 shows the liquid delivery apparatus 1 according to the fourth embodiment as applied to a micropump 100. The micropump 100 is configured such that a pump adaptor AP is connected to an under surface of the liquid delivery apparatus 1 of the first embodiment, and a lower part of the pump adaptor AP is immersed in a liquid source. When driven, a piezoelectric actuator plate 10 of this liquid delivery apparatus 1 operates similarly to the first embodiment, that is, deflects to be convex toward a relevant pressure chamber 21*a*. Thus, the inner volume of the pressure chamber 21*a* is reduced to deliver the liquid in the pressure chamber 21*a* outside the micropump 100 through one of outlets OP. When released from its driven state, the piezoelectric actuator plate 10 restores to its original or non-driven state, making the inner pressure of the pressure chamber 21*a* negative, and thus the liquid is introduced from a liquid source into the pressure chamber 21*a* via an inlet IP.

Fifth Embodiment

Figure 8:
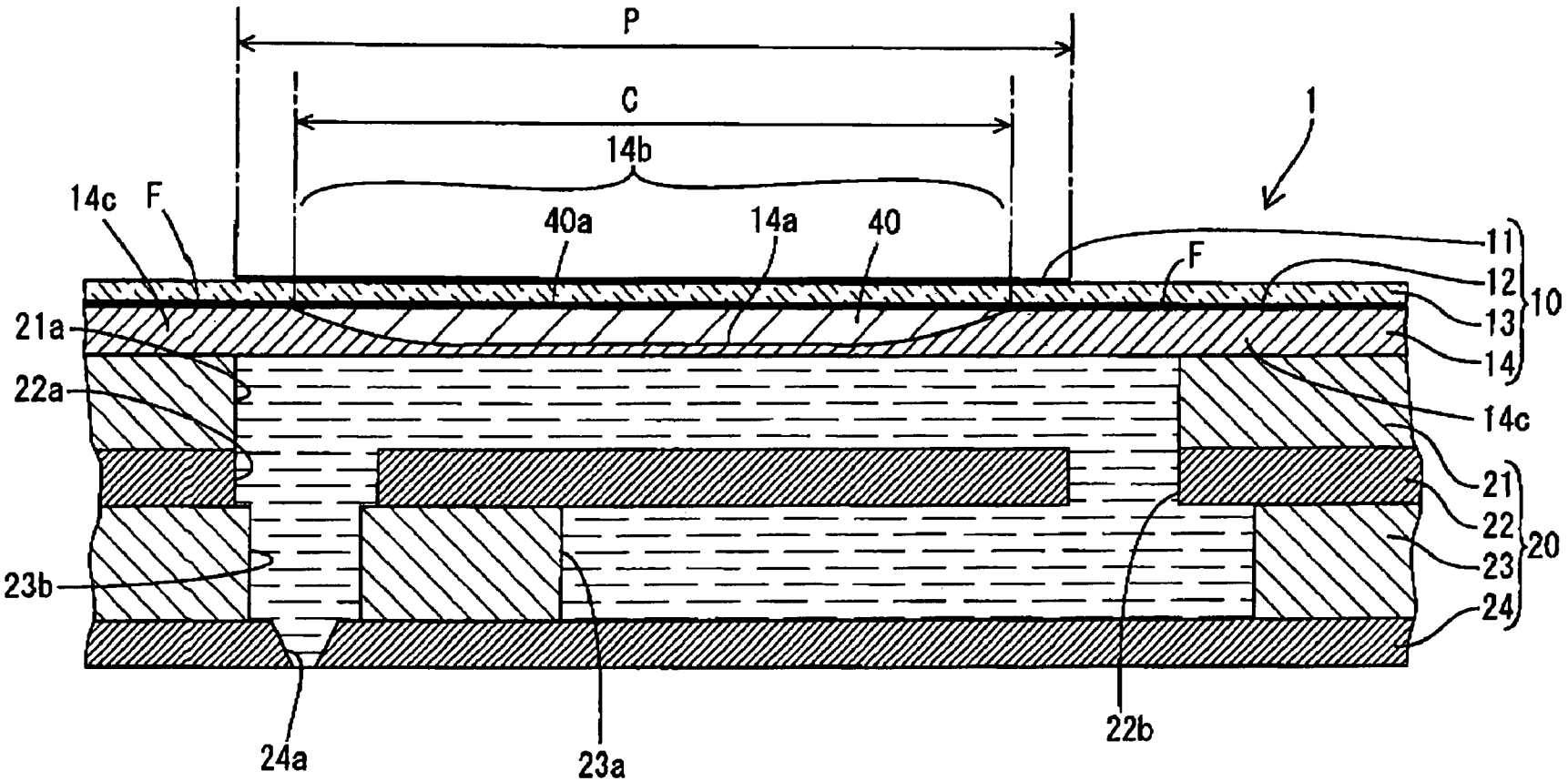
FIG. 8 is a cross sectional view as taken along a longitudinal direction of a pressure chamber of a liquid delivery apparatus according to a fifth embodiment of the invention.
Figure 9:
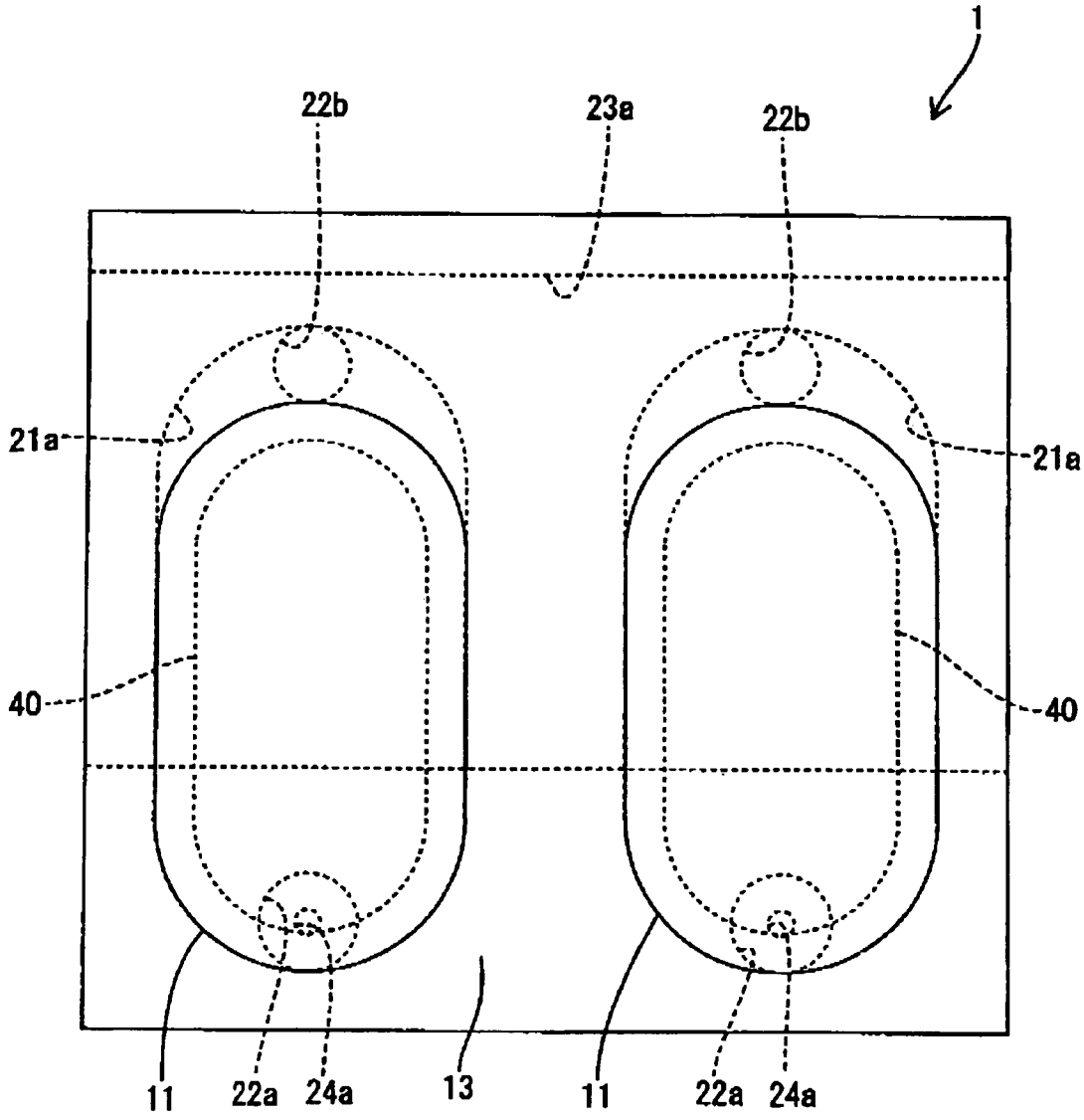
FIG. 9 is a plan view of the apparatus of the fifth embodiment.
Figure 10A:
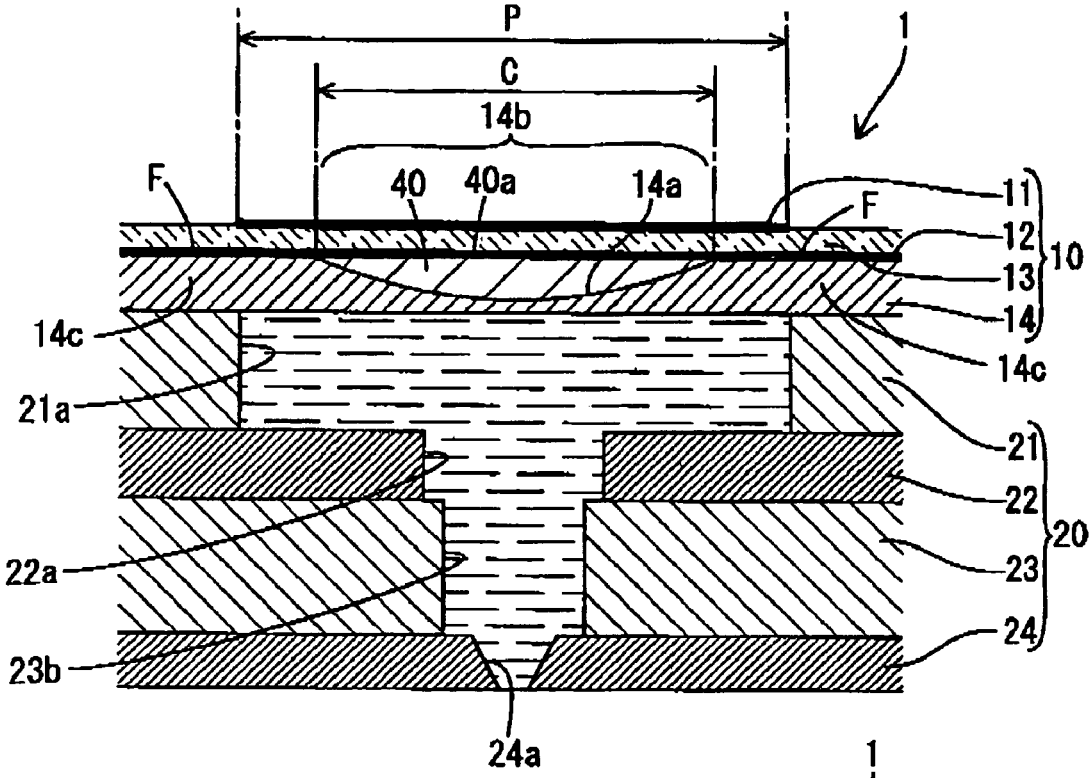
FIGS. 10A and 10B are cross sectional views as taken along the shorter side of a pressure chamber of the apparatus of the fifth embodiment.
Figure 10B:
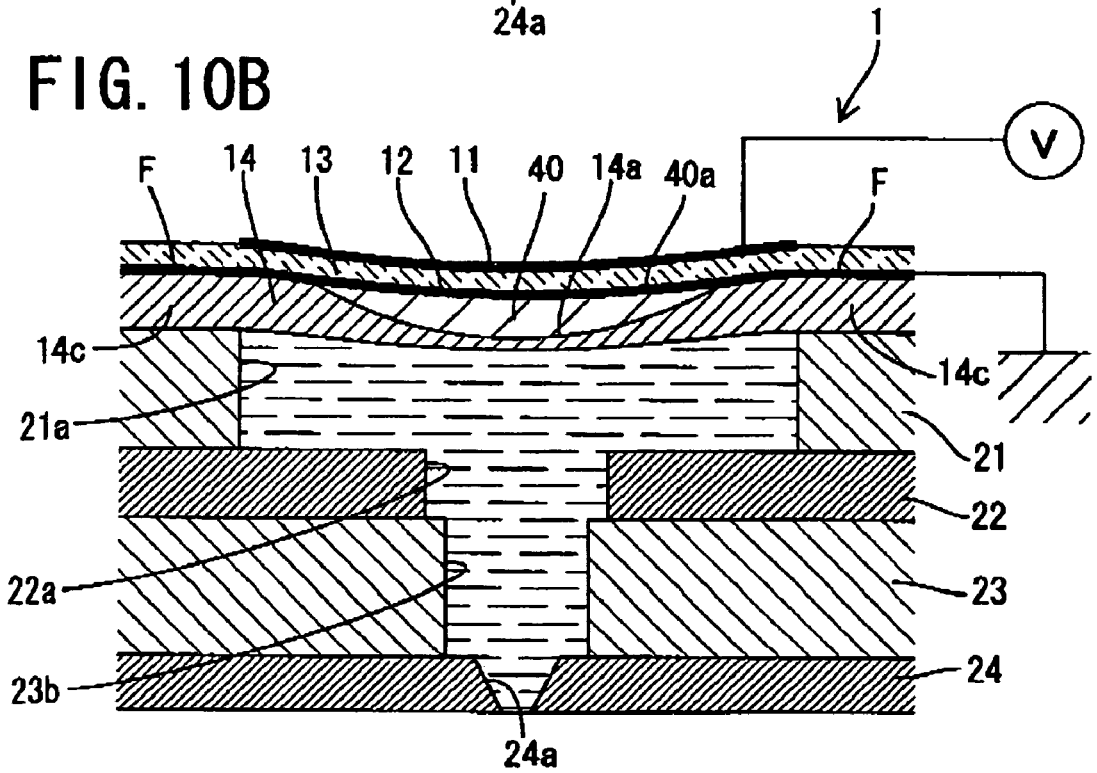

FIG. 8 is a sectional view as taken in the longitudinal direction of a pressure chamber 21*a* of a liquid delivery apparatus 1 according to a fifth embodiment of the invention, while FIG. 9 is a plan view of the apparatus 1. FIGS. 10A and 10B are cross sectional views as taken along the shorter side of the pressure chamber 21*a*; FIG. 10A shows a state of the apparatus 1 where a piezoelectric actuator plate 10 is not driven, while FIG. 10B shows a state where the piezoelectric actuator plate 10 is driven.

The apparatus 1 of the fifth embodiment is different from that of the first embodiment in that a void defined between a thinner portion 14*a* of a diaphragm 14 and a piezoelectric layer 13 (or more strictly, a lower electrode 12) is filled with a low elastic material 40 having an elastic modulus lower than that of the layers 14 and 13. The other structures of the fifth embodiment are identical with the first embodiment. Hence, the same elements are denoted by the reference numerals as used in the first embodiment, and detailed description thereof is omitted.

As shown in FIG. 8, the liquid delivery apparatus 1 according to the present embodiment has a cavity plate 20, a diaphragm 14, a piezoelectric layer 13, an upper electrode 11, and a lower electrode 12, similar to the corresponding elements of the first embodiment. The diaphragm 14 has, at an area C corresponding to a central part of the pressure chamber 21*a*, a non-fixed portion 14*b* not fixed to the piezoelectric layer 13. The non-fixed portion 14*b* includes the thinner portion 14*a* whose thickness is smaller than a fixed portion 14*c* where diaphragm 14 is bonded to the piezoelectric layer 13. The void defined between the non-fixed portion 14*a* and the piezoelectric layer 13 (or more strictly the lower electrode 12) is filled with the material 40 having the lower modulus of elasticity. As shown in FIGS. 8 and 10A, the material 40 having the lower elastic modulus is configured such that an upper surface 40*a* of the material 40 remote from the pressure chamber 21*a* is substantially flush in its planar direction with a fixed surface F of the fixed portion 14*c* (more specifically, the surface where the fixed portion 14*c* is fixed to the lower electrode 12). The piezoelectric layer 13 is substantially plane at least at a part thereof positionally corresponding to the pressure chamber 21*a*.

Similarly to the first embodiment, the piezoelectric layer 13 of the present embodiment is formed of a piezoelectric ceramic material, more specifically, lead (Pb)-zirconate-titanate (PZT), while the diaphragm 14 is formed of a stainless steel. The material 40 has an elastic modulus lower than that of the diaphragm 14 and piezoelectric layer 13. For instance, the material 40 is a polyimide or epoxy resin. The piezoelectric layer 13, diaphragm 14, and material 40 are laminated to together constitute the piezoelectric actuator plate 10. In the present embodiment, the elastic moduli of the piezoelectric layer 13, the diaphragm 14, and the material 40 are respectively 60 GPa, 200 GPa, and 4 GPa.

As shown in FIG. 9, the pressure chamber 21*a* as seen from the upper side has an oblong shape, and a circumference of the non-fixed portion 14*b* (i.e., a circumference of the low elastic material 40) is located at a position right over, or over the immediately inner side of, the circumference of the pressure chamber 21*a*. That is, when seen from the upper side of the apparatus 1, the circumference of the non-fixed portion 14*b* (or the circumference of the material 40) is not present outside the pressure chamber 21*a*. In other words, the entirety of the non-fixed portion 14*b* is disposed within the pressure chamber 21*a*. More specifically, a shape of the thinner portion 14*a* or the low elastic material 40 has an oblong shape which is similar to, but slightly smaller than, the shape of the pressure chamber 21*a* as seen from the upper side.

As shown in FIGS. 8 and 10A, an opposing area P where the electrode layers 11, 12 are opposed to each other via the piezoelectric layer 13 is wider than an area of the non-fixed portion 14*b* such that the opposing area P extends over an entirety of the non-fixed portion 14*b* or the material 40. In the plan view of FIG. 9 is shown an arrangement where the area of the upper electrode 11 corresponds to the opposing area P of the electrode layers 11, 12, and the area of the non-fixed portion 14*b* or the low elastic material 40 is made slightly smaller than the opposing area P.

In the liquid delivery apparatus 1 constructed as described above, when a power supply voltage is applied to the upper electrode 11, a voltage is generated between the upper and lower electrodes 11 and 12. As a result, the piezoelectric layer 13 starts contracting in the planar direction, and immediately after the initiation of the contraction the thinner portion 14*a* of the diaphragm 14 is easily deflected or bent to be convex toward the pressure chamber 21*a*. The piezoelectric layer 13 is pulled to the pressure chamber 21*a*. Thus, the piezoelectric actuator plate 10 becomes convex toward the pressure chamber 21*a* as shown in FIG. 10B. Since the void defined between the thinner portion 14*a* of the diaphragm 14 and the piezoelectric layer 13 (or more strictly the lower electrode 12) is filled with the material 40 having the elastic modulus lower than that of the diaphragm 14 and piezoelectric layer 13, the layer 13 is supported by the material 40 at a part positionally corresponding to the thinner portion 14*a*. Hence, compared to the case where the void is not filled with the material 40, the concentration of stress at a peripheral part of the non-fixed portion 14*b* is alleviated, enhancing the mechanical durability of the piezoelectric actuator plate 10.

Sixth Embodiment

There will next be described a sixth embodiment of the invention by reference to FIGS. 11A and 11B.

Figure 11A:
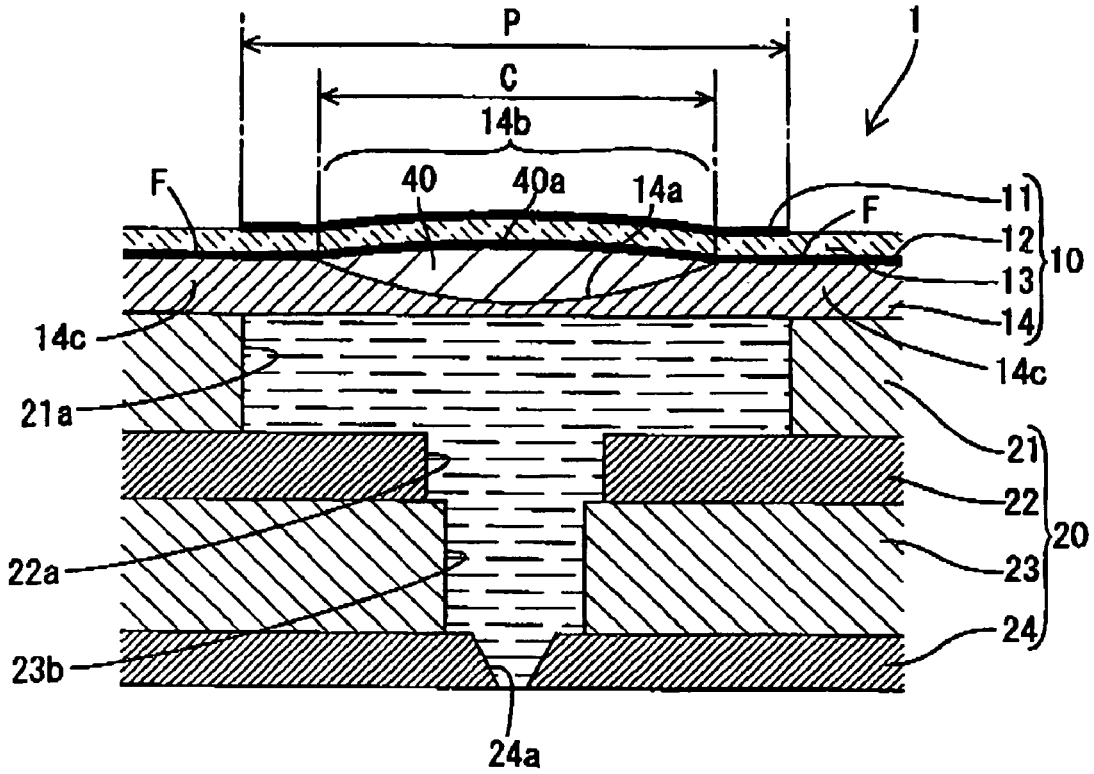
FIGS. 11A and 11B are cross sectional views as taken along the shorter side of a pressure chamber of a liquid delivery apparatus according to a sixth embodiment.
Figure 11B:
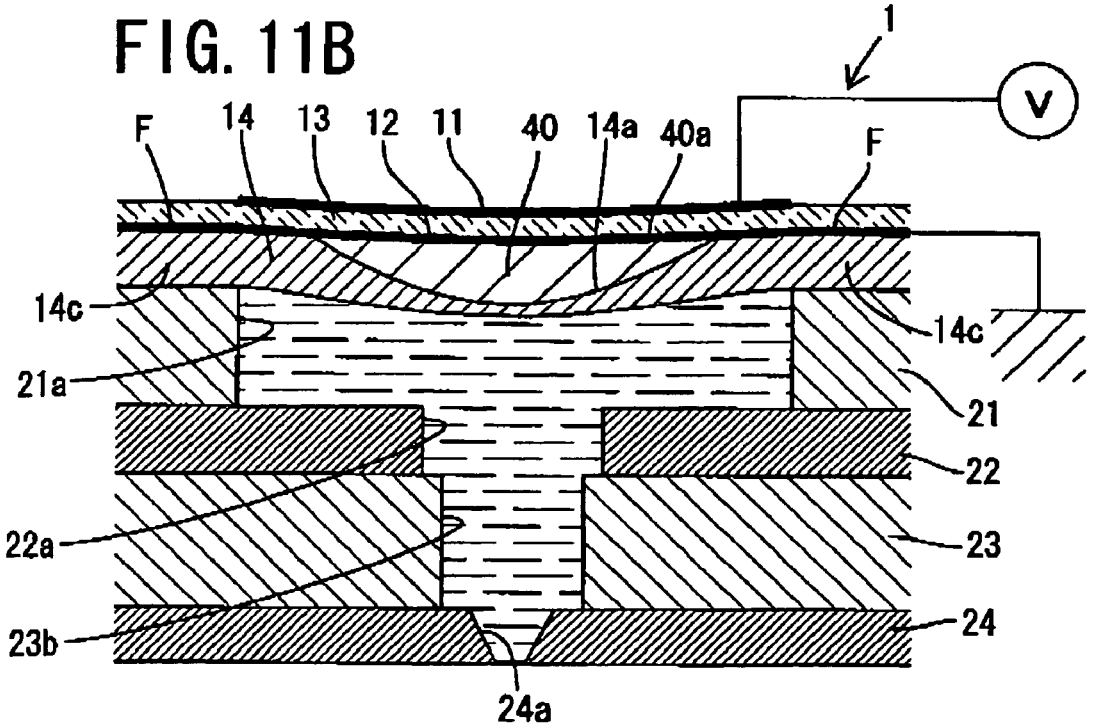

FIGS. 11A and 11B are sectional views as taken along the shorter side of a pressure chamber of a liquid delivery apparatus 1 according to the sixth embodiment; FIG. 11A shows a state where a piezoelectric actuator plate 10 is not driven, while FIG. 11B shows a state where the piezoelectric actuator plate 10 is driven.

In the liquid delivery apparatus 1 of the present embodiment, a void defined between a thinner portion 14*a* of a diaphragm 14 and a piezoelectric layer 13 (or more strictly a lower electrode 12) is filled with a material 40 having an elastic modulus lower than that of the diaphragm 14 and piezoelectric layer 13, similarly to the fifth embodiment. When the actuator plate 10 is not driven, the material 40 is convex in the direction away from a pressure chamber 21*a*, with respect to a bonded surface F where a fixed portion 14*c* of the diaphragm 14 is fixed to the piezoelectric layer 13 via a lower electrode 12. The other structures of the sixth embodiment are identical with the fifth embodiment, except that the low elastic material 40 is convex with respect to the bonded surface F (more specifically, the bonded surface where the fixed portion 14*c* is bonded to the lower electrode 12).

As shown in FIG. 1A, the piezoelectric layer 13 is convex in the direction away from the pressure chamber 21*a*, conforming to the shape of the material 40 convex in the same direction with respect to the bonded surface F, at the area C. For instance, the low elastic material 40 between the diaphragm 14 and the piezoelectric layer 13 (or more strictly, the lower electrode 12) is formed by performing intaglio printing on the diaphragm 14 where a thinner portion 14*b* has been already formed, while the piezoelectric layer 13 is formed, after the formation of the low elastic material 40, by aerosol deposition, sputtering, CVD (chemical vapor deposition), hydrothermal synthesis, sol-gel process or by other methods.

In the above-described arrangement where the low elastic material 40 filling the void defined between the piezoelectric layer 13 (or more strictly the lower electrode 12) and the diaphragm 14 is made convex with respect to the bonded surface F so that the layer 13 is accordingly convex in the direction away from the diaphragm 14, when a voltage is generated between the upper and lower electrodes 11, 12 and the piezoelectric layer 13 contracts in its planar direction, the material 40 is pushed toward the pressure chamber 21*a*. Thus, the diaphragm 14 can be greatly displaced. According to the present embodiment, an efficient drive of the actuator plate 10 with a lower voltage can be realized.

Seventh Embodiment

There will be described a seventh embodiment of the invention by reference to FIGS. 12A, 12B and 13.

Figure 12A:
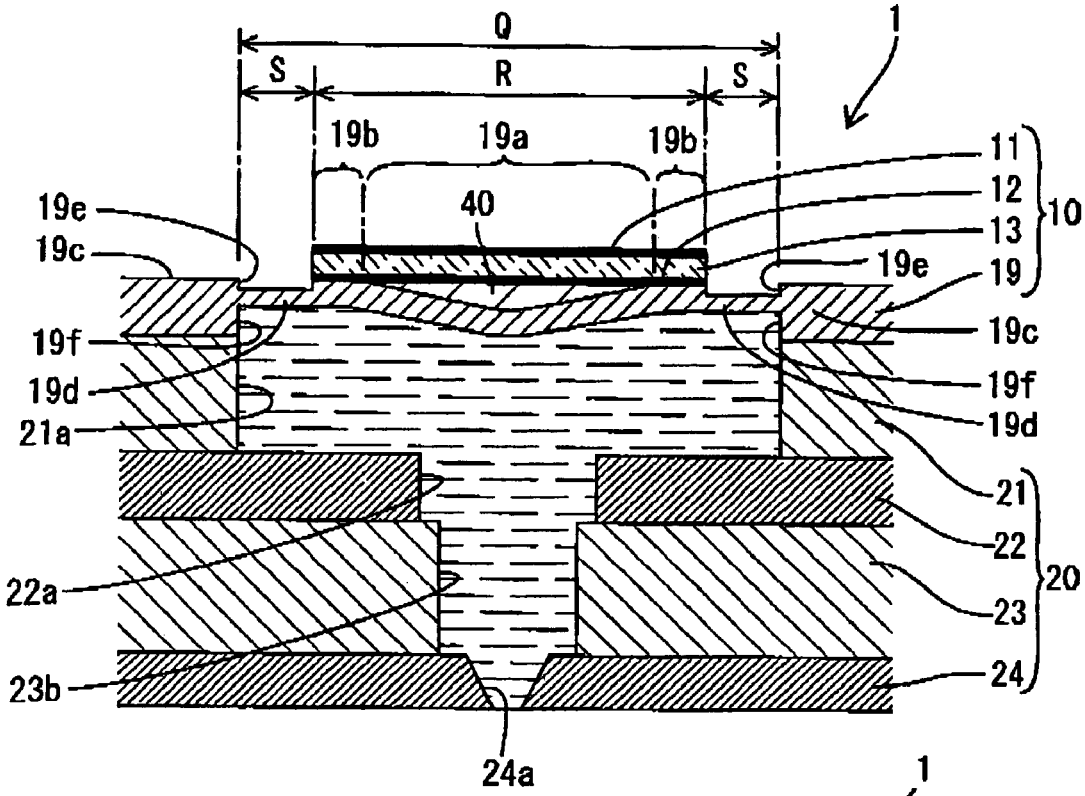
FIGS. 12A and 12B are cross sectional views as taken along the shorter side of a pressure chamber of a liquid delivery apparatus according to a seventh embodiment.
Figure 12B:
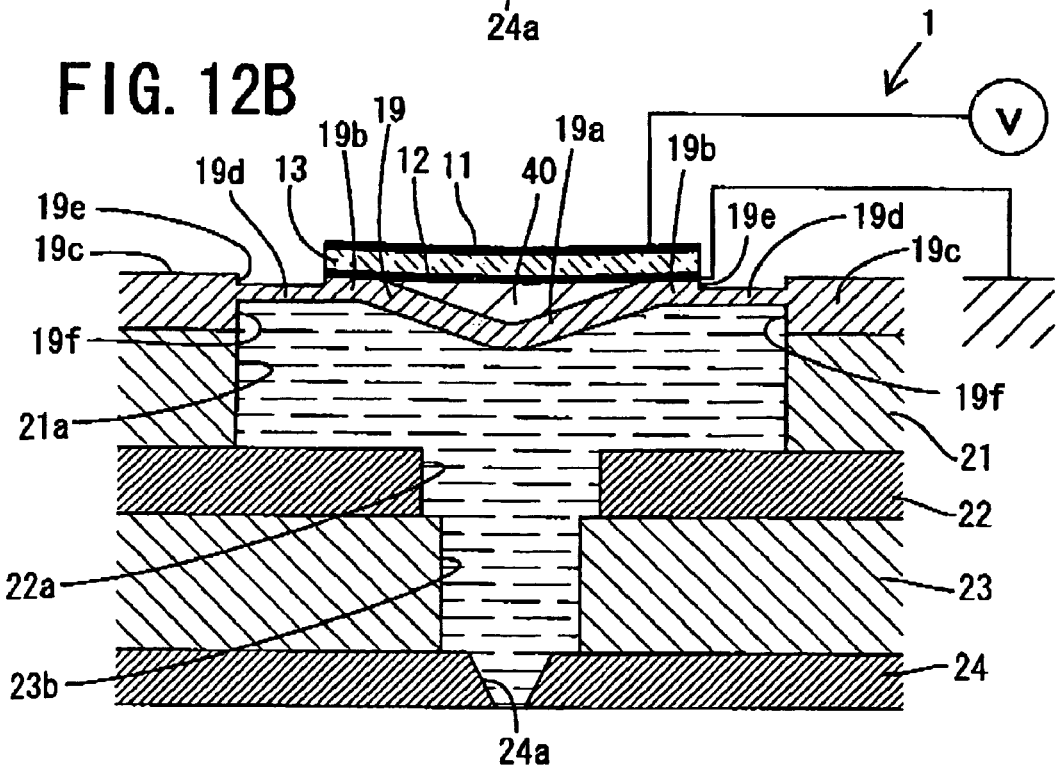

FIGS. 12A and 12B are cross sectional views as taken along the shorter side of a pressure chamber of a liquid delivery apparatus 1 according to the seventh embodiment; FIG. 12A shows a state where a piezoelectric actuator plate 10 of the apparatus 1 is not driven, while FIG. 12B shows a state where the actuator plate 10 is driven.

Figure 13:
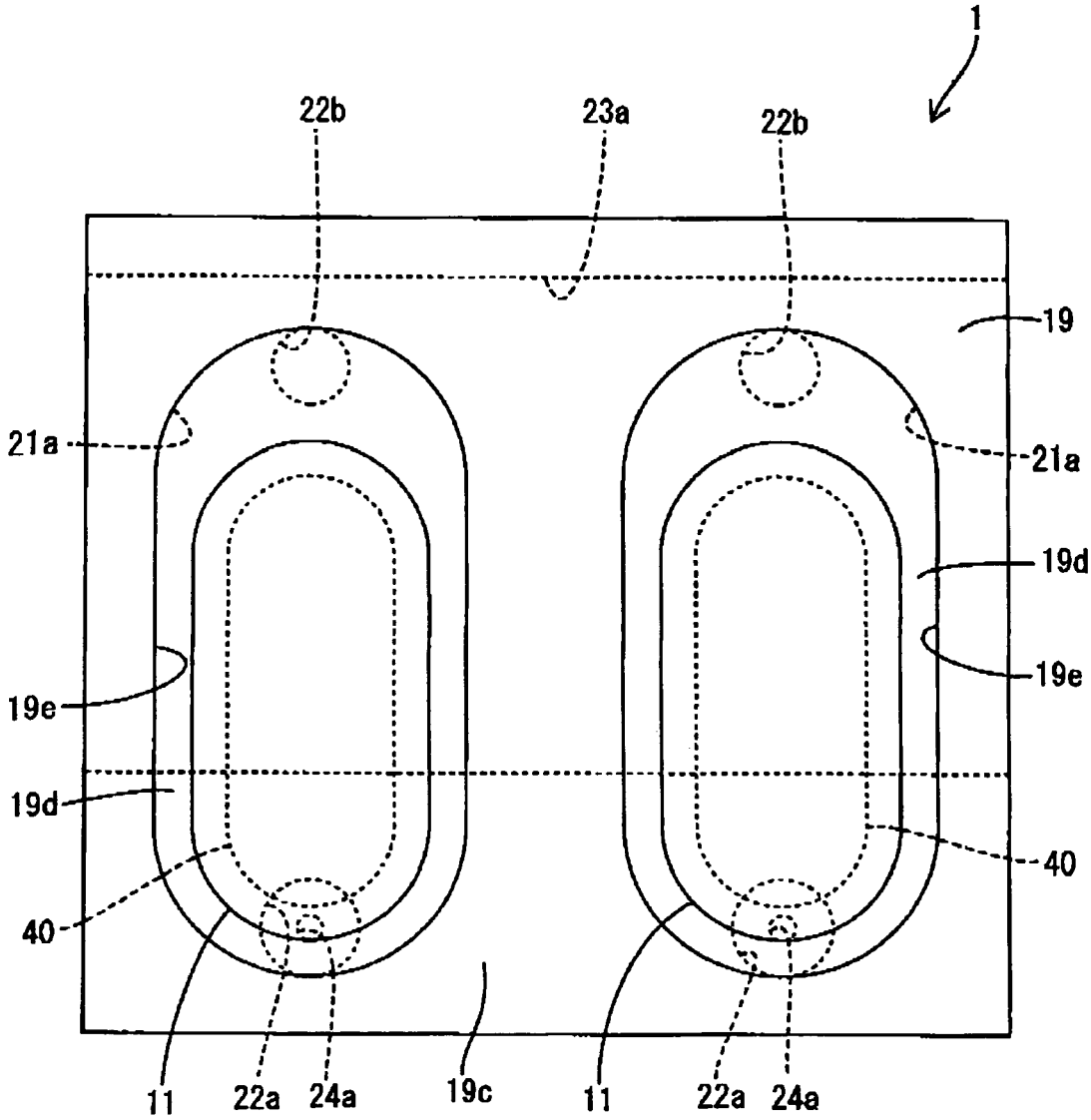
FIG. 13 is a plan view of the liquid delivery apparatus of the seventh embodiment.

As shown in FIGS. 12A and 12B, the liquid delivery apparatus 1 is configured such that a piezoelectric layer 13 is smaller, in a cross sectional area taken along a planar direction of the piezoelectric layer 13, than the pressure chamber 21*a*, and that an entirety of an area of the piezoelectric layer 13 (which corresponds to an area where an upper electrode 11 is provided, as shown in FIG. 13) overlaps the pressure chamber 21*a*.

As shown in FIGS. 12A and 12B, a diaphragm 19 formed of the same material as the diaphragm of the first embodiment (i.e., a metallic material such as a stainless steel) is configured such that at an area S, which is defined inside an area Q positionally corresponding to a pressure chamber 21*a*, and at which the piezoelectric layer 13 is not provided, the diaphragm 19 has a thickness smaller than that at the remaining area R inside the area Q where the piezoelectric layer 13 is provided. More specifically, a part of the diaphragm 19 positionally corresponding to an inner periphery of the pressure chamber 21*a* is defined as the area S where a reduced-thickness portion 19*d*, on which the piezoelectric layer 13 is not provided, is formed. There is provided an upper-side groove 19*e* on the upper side of the diaphragm 19 at the area S, while on the underside of the reduced-thickness portion 19*d* is defined an underside groove 19*f* of the diaphragm 19. The upper-side groove 19*e* is formed in an annular shape around the piezoelectric layer 13.

On the other hand, the area corresponding to a central part of the pressure chamber 21*a* is defined as an area R where the piezoelectric layer 13 is provided. At this area R, the diaphragm 19 has a non-fixed portion 19*a* and a fixed portion 19*b*, which have respective thicknesses each larger than that of the reduced-thickness portion 19*d*. The void defined between the piezoelectric layer 18 and the diaphragm 19 (more strictly, the void defined between the non-fixed portion 19*a* and the lower electrode 12) is filled with a material 40 having a lower elastic modulus similar to that in the fifth and sixth embodiments. However, this void may be left not being filled with the material 40. The diaphragm 19 further has a plate-fixed portion 19*c* at a position over a part of a chamber plate 21 located on the outer side of the pressure chamber 21*a*. At the plate-fixed portion 19*c*, the diaphragm 19 is fixed or bonded to the chamber plate 21. A thickness of the plate-fixed portion 19*c* is larger than that of the reduced-thickness portion 19*d*.

According to the seventh embodiment, at the area corresponding to an outer periphery of the piezoelectric layer 13, the diaphragm 19 has a lower rigidity than at the area where the piezoelectric layer 13 is provided. Hence, the degree of displacement of the diaphragm 19 upon contraction of the piezoelectric layer 13 in its planar direction can be enhanced.

Other Embodiments

It is to be understood that the present invention is not limited to the details of the above-described embodiments and drawings, but the modified embodiments as follows may be included within the technical scope of the invention. Further, the following modified embodiments may be implemented with various changes without departing from the gist of the invention.

(1) It may be arranged such that the upper electrode is connected to the ground of the drive circuit, while the lower electrode is connected to the positive power supply of the drive circuit.

Further, it may be arranged such that the direction of polarization and the direction of electric field application at the piezoelectric layer are opposite to each other, unlike the above-described embodiments. In this case, the piezoelectric layer contracts in the direction of its thickness to expand in its planar direction, and the piezoelectric actuator plate is deformed in a direction to increase the inner volume of the pressure chamber.

(2) The liquid delivery apparatus according to the present invention may be any types of apparatuses with respect to the form of the liquid delivered to the outside through the opening in communication with the pressure chamber. That is, the liquid delivered through the opening may take any form, e.g., droplets and mist. In addition, any mode of delivery of the liquid may be employed. For instance, the liquid may be jetted, ejected, or sprayed.

(3) Although ink jet heads of a printer have been described as the embodiments of the invention by way of example, the principle of the invention is applicable to any other kinds of liquid delivery apparatuses, such as a test-reagent ejecting apparatus.

What is claimed is:

1. A liquid delivery apparatus comprising:

a pressure chamber accommodating a liquid and communicated with an opening; and a piezoelectric actuator plate which is disposed to close the pressure chamber and is deflected to deliver the liquid accommodated in the pressure chamber through the opening, and which has a laminated structure including:

a piezoelectric layer including a deformable area which is provided over a central part of the pressure chamber and is deformable at least in a planar direction thereof by an application of an electric field to the deformable area; and a planar diaphragm which has a recess in one surface of opposite surfaces thereof such that the recess is defined by a thinner portion thereof located over the central part of the pressure chamber, and which is laminated at the one surface thereof to the piezoelectric layer, the one surface comprising a fixed portion which is fixed to the piezoelectric layer around the recess.

2. The apparatus according to claim 1, wherein an entire part of the thinner portion is not fixed to the piezoelectric layer and the recess is void.

3. The apparatus according to claim 1, wherein the thinner portion has an oblong shape slightly smaller than a shape of the pressure chamber as seen from a direction perpendicular to the planar direction of the piezoelectric layer.

4. The apparatus according to claim 1, wherein a thickness of the thinner portion gradually reduces in the planar direction from its peripheral part toward its central part which positionally corresponds to the central part of the pressure chamber.

5. The apparatus according to claim 1, wherein the thinner portion is formed by etching a planar member as a material of the diaphragm.

6. A liquid delivery apparatus comprising:

a pressure chamber accommodating a liquid and communicated with an opening; and a piezoelectric actuator plate which is disposed to close the pressure chamber and is deflected to deliver the liquid accommodated in the pressure chamber through the opening, and which has a laminated structure including a piezoelectric layer which is deformable at least in a planar direction thereof by an application of an electric field to the piezoelectric layer, and a planar diaphragm which has a recess in one surface of opposite surfaces thereof such that the recess is defined by a thinner portion thereof located over a center part of the pressure chamber, and which is laminated at the one surface thereof to the piezoelectric layer, the one surface comprising a fixed portion which is fixed to the piezoelectric layer around the recess, wherein the diaphragm is a laminated structure comprised of a first planar member and a second planar member, the first planar member having a through-hole formed therein, thereby forming the thinner portion as a part of the second planar member.

7. A liquid delivery apparatus comprising: a pressure chamber accommodating a liquid and communicated with an opening; and a piezoelectric actuator plate which is disposed to close the pressure chamber and is deflected to deliver the liquid accommodated in the pressure chamber through the opening, and which has a laminated structure including a piezoelectric layer which is deformable at least in a planar direction thereof by an application of an electric field to the piezoelectric layer, and a planar diaphragm which has a recess in one surface of opposite surfaces thereof such that the recess is defined by a thinner portion thereof located over a center part of the pressure chamber, and which is laminated at the one surface thereof to the piezoelectric layer, the one surface comprising a fixed portion which is fixed to the piezoelectric layer around the recess, wherein the recess is filled with a low elastic material having an elastic modulus lower than those of the diaphragm and the piezoelectric layer.

8. The apparatus according to claim 7, wherein the low elastic material filling the recess is convex with respect to a fixed surface where the fixed portion of the diaphragm and the piezoelectric layer are fixed to each other, and the piezoelectric layer conforms to the convex shape of the material to have a part convex in a direction away from the pressure chamber.

9. The apparatus according to claim 7, wherein the low elastic material is made of one of a polyimide resin and an epoxy resin.

10. A liquid delivery apparatus comprising: a pressure chamber accommodating a liquid and communicated with an opening; and a piezoelectric actuator plate which is disposed to close the pressure chamber and is deflected to deliver the liquid accommodated in the pressure chamber through the opening, and which has a laminated structure including a piezoelectric layer which is deformable at least in a planar direction thereof by an application of an electric field to the piezoelectric layer, and a planar diaphragm which has a recess in one surface of opposite surfaces thereof such that the recess is defined by a thinner portion thereof located over a center part of the pressure chamber, and which is laminated at the one surface thereof to the piezoelectric layer, the one surface comprising a fixed portion which is fixed to the piezoelectric layer around the recess, wherein the piezoelectric layer is smaller, in a cross sectional area taken along the planar direction of the piezoelectric layer, than the pressure chamber such that an entirety of the piezoelectric layer overlaps the pressure chamber, and wherein the diaphragm has a part located over the pressure chamber and the part includes a first portion over which the piezoelectric layer is not present and a second portion over which the piezoelectric layer is present, the first portion being thinner than the second portion.

11. The apparatus according to claim 1, wherein a circumference of the thinner portion is located at or within a circumference of the pressure chamber as seen in a direction perpendicular to the planar direction of the piezoelectric layer.

12. The apparatus according to claim 10, wherein the thinner first portion of the diaphragm is formed in an annular shape around the piezoelectric layer.

13. The apparatus according to claim 1, wherein the piezoelectric actuator plate further comprises two electrode layers which are disposed on respective opposite sides of the piezoelectric layer with the diaphragm being fixed to the piezoelectric layer via one of the electrode layers, and the deformable area of the piezoelectric layer comprises an opposing area via which the electrode layers are opposed to each other and which is wider than the thinner portion and extends over an entirety of the thinner portion.

14. The apparatus according to claim 1, which serves as a print head of an ink jet printer, wherein an ink accommodated as the liquid in the pressure chamber is ejected from the opening in communication with the pressure chamber.

15. A micropump comprising:

the liquid delivery apparatus according to claim 1; and a pump adapter connected to the liquid delivery apparatus and having an inlet and an outlet which are in communication with the pressure chamber and the opening of the liquid delivery apparatus, respectively, the inlet being immersed in a source of the liquid so that the liquid is sucked into the micropump through the inlet and delivered to an outside of the micropump through the outlet, via the pressure chamber and the opening.

16. A liquid delivery apparatus comprising:

a pressure chamber accommodating a liquid and communicated with an opening; and a piezoelectric actuator plate which is disposed to close the pressure chamber and is deflected to deliver the liquid accommodated in the pressure chamber through the opening, and which has a laminated structure including:

a piezoelectric layer including a deformable area which is provided over a central part of the pressure chamber and is deformable at least in a planar direction thereof by an application of an electric field to the deformable area; and a planar diaphragm laminated at one surface of opposite surfaces thereof to the piezoelectric layer, the one surface comprising a fixed portion which is fixed to the piezoelectric layer, and a non-fixed portion which is not fixed to the piezoelectric layer, the non-fixed portion being provided over the central part of the pressure chamber and the fixed portion being provided around the non-fixed portion.

17. The apparatus according to claim 16, wherein the non-fixed portion has an oblong shape slightly smaller than a shape of the pressure chamber as seen from a direction perpendicular to the planar direction of the piezoelectric layer.

18. The apparatus according to claim 16, wherein the piezoelectric actuator plate further comprises two electrode layers which are disposed on respective opposite sides of the piezoelectric layer with the diaphragm being fixed to the piezoelectric layer via one of the electrode layers, and the deformable area of the piezoelectric layer comprises an opposing area via which the electrode layers are opposed to each other and which is wider than the non-fixed portion and extends over an entirety of the non-fixed portion.

19. The apparatus according to claim 16, which serves as a print head of an ink jet printer, wherein an ink accommodated as the liquid in the pressure chamber is ejected from the opening in communication with the pressure chamber.

20. A liquid delivery apparatus comprising:

a pressure chamber accommodating a liquid and communicated with an opening; and a piezoelectric actuator plate which is disposed to close the pressure chamber and is deflected to deliver the liquid accommodated in the pressure chamber through the opening, and which has a laminated structure including:

a piezoelectric layer including a deformable area which corresponds to the pressure chamber and is deformable at least in a planar direction thereof by an application of an electric field to the deformable area; and a planar diaphragm which has a recess in one surface of opposite surfaces thereof such that the recess is defined by a thinner portion thereof located over a central part of the pressure chamber, and which is laminated at the one surface thereof to the piezoelectric layer, the one surface comprising a fixed portion which is fixed to the piezoelectric layer around the recess, wherein, in a cross sectional view taken along a plane perpendicular to the piezoelectric actuator plate, a length of the deformable area of the piezoelectric layer is greater than a length of the thinner portion of the planar diaphragm, and is not greater than a length of the pressure chamber.

21. The apparatus according to claim 20, wherein the deformable area of the piezoelectric layer extends over an entirety of the thinner portion, and an entirety of the deformable area of the piezoelectric layer overlaps the pressure chamber, as seen in a direction perpendicular to the planar direction of the piezoelectric layer.

* * * * *